United States Patent [19]

Hartzler

[11] 4,017,313

[45] Apr. 12, 1977

[54] PHOTOSENSITIVE COMPOSITION CONTAINING A LEUCO DYE, A PHOTOSENSITIZER, AN AROMATIC ALDEHYDE AND A SECONDARY OR TERTIARY AMINE AND THE USE THEREOF IN A DIRECT-PRINT PROCESS

[75] Inventor: Harris Dale Hartzler, Wilmington, Del.

[73] Assignee: E. I. Du Pont de Nemours and Company, Wilmington, Del.

[22] Filed: July 24, 1975

[21] Appl. No.: 599,013

Related U.S. Application Data

[63] Continuation-in-part of Ser. No. 511,029, Sept. 30, 1974, abandoned.

[52] U.S. Cl. ..... 96/48 QP; 96/90 R

[51] Int. Cl.[2] ..... G03C 5/24; G03C 1/52

[58] Field of Search ..... 96/90 R, 90 PC, 48 QP

[56] References Cited

UNITED STATES PATENTS

| | | | |
|---|---|---|---|
| 3,121,632 | 2/1964 | Sprague et al. | 96/90 R |
| 3,390,996 | 7/1968 | MacLachlan | 96/48 R |
| 3,579,342 | 5/1971 | Strilko | 96/90 R |
| 3,637,390 | 1/1972 | Peterson | 96/90 R |
| 3,820,995 | 6/1974 | Mertens et al. | 96/90 R |
| 3,909,266 | 9/1975 | Inoue et al. | 96/90 PC |

*Primary Examiner*—Won H. Louie, Jr.

[57] ABSTRACT

High imaging speeds are obtained with leuco dye compositions which comprise 1. a photosensitive leuco dye,
2. a photosensitizer for the dye selected from the group consisting of ketones, hexaarylbiimidazoles and perylene,
3. an aromatic aldehyde, and
4. a secondary or tertiary amine.

21 Claims, No Drawings

PHOTOSENSITIVE COMPOSITION CONTAINING A LEUCO DYE, A PHOTOSENSITIZER, AN AROMATIC ALDEHYDE AND A SECONDARY OR TERTIARY AMINE AND THE USE THEREOF IN A DIRECT-PRINT PROCESS

CROSS-REFERENCE TO RELATED APPLICATION

This is a continuation-in-part of my copending application Ser. No. 511,029, filed Sept. 30, 1974 now abandoned.

BACKGROUND OF THE INVENTION

1. Field of the Invention

This invention relates to color imaging by photochemical oxidation of leuco dyes.

2. Description of the Prior Art

Photochemical oxidation of leuco dyes is well known in the art. It is also known to employ sensitizers in the system to increase the rate of leuco dye oxidation, and a variety of sensitizers have been employed for this purpose. In U.S. Pat. No. 3,121,632 Sprague et al. describe the use of aldehydes and/or ketones as activators. In U.S. Pat. No. 3,390,996 MacLachlan teaches photosensitive compositions containing a leuco dye such as an aminotriarylmethane, a photooxidant such as a hexaarylbiimidazole, and a redox couple which is a combination of a reductant and an oxidant. In a long list of suitable reductant components, several aromatic aldehydes are mentioned. Suitable oxidants include aromatic ketones and quinones.

SUMMARY OF THE INVENTION

It has now been discovered that the combination of certain aldehydes, a suitable photosensitizer, and an amine used in the photochemical oxidation of leuco dyes results in a system having extremely high imaging speeds. The radiation sensitive leuco dye compositions of the present invention comprise 1. a photosensitive leuco dye,
2. about 0.01 to about 50 parts by weight, per part of leuco dye, of a photosensitizer for the dye selected from the group consisting of ketones, hexaarylbiimidazoles and perylene,
3. about 0.5 to about 100 parts by weight, per part of leuco dye, of an aromatic aldehyde and
4. about 0.1 to about 10 parts by weight, per part of aromatic aldehyde, of a secondary or tertiary amine in which all carbon atoms to which the amino group is attached are aliphatic.

The invention also includes a method for producing colored images on a substrate which comprises (a) coating the substrate with the radiation sensitive leuco dye composition described above, and (b) exposing the leuco dye composition to radiation, a portion of which contains wavelengths between about 2000 and 5000A, through an image-bearing transparency to obtain a colored image.

DETAILED DESCRIPTION OF THE INVENTION

The leuco dyes which are suitable for use in the present invention include those which are oxidized to a colored form by exposure to radiation. Suitable leuco dyes include aminotriarylmethanes, aminoxanthenes, aminothioxanthenes, amino-9,10-dihydroacridines, aminophenoxazines, aminophenothiazines, aminodihydrophenazines, aminodiphenylmethanes, aminohydrocinnamic acids and the corresponding esters and nitriles, leuco indamines, leuco indigoid dyes, hydrazines, amino-2,3-dihydroanthraquinoes, tetrahalo-p,p'-biphenols, 2-(p-hydroxyphenyl)-4,5-diphenylimidazoles, phenethylanilines, and the like. These leuco dyes are described in greater detail by Cescon et al. in U.S. Pat. Nos. 3.445,234; 3,423,427; and 3,449,379 and by Read in U.S. Pat. Nos. 3,395,018 and 3,390,997.

The preferred leuco dyes for use in the present invention are aminotriarylmethanes and aminophenothiazines. The preferred aminotriarylmethanes are those of the formula

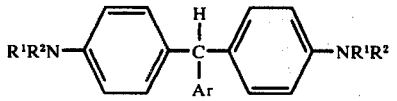

wherein $R^1$ and $R^2$, alike or different, are selected from the group consisting of hydrogen, $C_1$ to $C_{10}$ alkyl, 2-hydroxyethyl, 2-cyanoethyl, benzyl and phenyl; and Ar is selected from the group consisting of

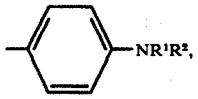

thienyl, furyl, oxazolyl, pyridyl, thiazolyl, indolyl, indolinyl, benzoxazolyl, quinolyl, benzothiazolyl, phenyl, and naphthyl. Preferably the third aryl group is the same as the first two. Strilko, U.S. Pat. No. 3,666,466, lists specific aminotriarylmethanes at column 7, line 55 through column 10, line 72 which are useful in this invention. These compounds are specifically incorporated by reference into the instant disclosure. Particularly preferred aminotriarylmethanes include Leucocrystal Violet, Leucomalachite Green, Leucomalachite Green-4''-chlorocarbonate hydrochloride and Leucocrystal Violet lactone. The preferred aminophenothiazine is Leucomethylene Blue.

Representative aminophenothiazine dues which may be employed in accordance with this invention include:

3,7-bis(dimethylamino)phenothiazine,
3,7-bis(dimethylamino)-4,6-dimethylphenothiazine,
3,7-bis(dimethylamino)-2,8-dimethylphenothiazine,
3,7-bis(dimethylamino)-4-nitrophenothiazine,
3,7-bis(dibutylamino)phenothiazine,
3-diethylamino-7-dimethylaminophenothiazine,
3-dimethylamino-7-N-benzyl-N-methylaminophenothiazine,
3,7-bis(N-benzyl-N-ethylamino)phenothiazine,
Lauth's Violet,
Gallothionin,
Brilliant Alizarine Blues,
10-benzoyl-3,7-bis(dimethylamino)phenothiazine,
10-(p-methoxybenzoyl)-3,7-bis(dimethylamino)-phenothiazine,
10-(p-chlorobenzoyl)-3,7-bis(dimethylamino)-phenothiazine,
10-(p-nitrobenzoyl)-3,7-bis(dimethylamino)phenothiazine,
10-propionyl-3,7-bis(dimethylamino)phenothiazine, and
10-acetyl-3,7-bis(dimethylamino)phenothiazine.

Photosensitizers which are useful in accordance with the present invention include substituted and unsubstituted ketones, hexaarylbiimidazoles, perylene and mixtures thereof. The use of ketone sensitizers is described in U.S. Pat. No. 3,121,632. Representative ketone photosensitizers which may be employed in this invention include:

acetophenone,
propiophenone,
butyrophenone,
i-butyrophenone,
valerophenone,
i-valerophenone,
t-butyl phenyl ketone,
n-amyl phenyl ketone,
n-hexyl phenyl ketone,
2-, 3-, and 4-methylacetophenone,
3,4-dimethylacetophenone,
2,4-dimethylacetophenone,
2,5-dimethylacetophenone,
3,5-dimethylacetophenone,
2,4,6-trimethylacetophenone,
ω-chloroacetophenone(phenacyl chloride),
ω,ω-dichloroacetophenone,
ω-bromoacetophenone,
ω-nitroacetophenone,
2-chloroacetophenone,
2-bromoacetophenone,
2-iodoacetophenone,
2-nitroacetophenone,
2-aminoacetophenone,
3-aminoacetophenone,
4-aminoacetophenone,
2-hydroxyacetophenone,
2-acetoxyacetophenone,
4-hydroxyacetophenone,
2-hydroxypropiophenone,
4-hydroxypropiophenone,
4-hydroxybutyrophenone,
3,4-dihydroxyacetophenone,
3,4-dimethoxyacetophenone,
2,4-dimethoxyacetophenone,
2,4-dihydroxyacetophenone,
2,5-dihydroxyacetophenone,
2,4-dihydroxypropiophenone,
2,4,5-trihydroxyacetophenone,
5-acetylisophthalic acid,
4-acetylphthalic acid,
ω-methoxyacetophenone,
ω-fluoroacetophenone,
ω-mercaptoacetophenone,
benzophenone,
2-, 3- and 4-chlorobenzophenone,
2,4-dichlorobenzophenone,
2,4'-dichlorobenzophenone,
4,4'-dichlorobenzophenone,
2-, 3- and 4-bromobenzophenone,
3,3'-dibromobenzophenone,
4-iodobenzophenone,
2-, 3- and 4-nitrobenzophenone,
4-fluorobenzophenone,
2,4'-dibromobenzophenone,
4'-chloro-3-nitrobenzophenone,
4,4'-dimethylbenzophenone,
2,4'-difluorobenzophenone,
2-, 3- and 4-methylbenzophenone,
4-chloromethylbenzophenone,
2'-bromo-4-methylbenzophenone,
4-phenylacetophenone,
2,4-dimethylbenzophenone,
3,4'-dimethylbenzophenone,
4-phenylpropiophenone,
2,4,5-trimethylbenzophenone,
4-ethylbenzophenone,
2-bromo-4'-methyl-5-nitrobenzophenone,
ω,ω,ω-trifluoro-4-phenylacetophenone,
4-(2-nitrophenyl)acetophenone,
cyclopropyl naphthyl ketone,
1-acetylnaphthalene,
4-fluoro-1-acetylnaphthalene,
4-chloro-1-acetylnaphthalene,
7-chloro-1-acetylnaphthalene,
7-chloro-1-chloroacetylnaphthalene,
2-acetylnaphthalene,
6-bromo-2-acetylnaphthalene,
1-propionylnaphthalene,
6-isopropyl-2-propionylnaphthalene,
4-ethylacetophenone,
2,5-dimethoxyacetophenone,
2,4-dichloroacetophenone,
2,5-dichloroacetophenone,
3-bromoacetophenone,
ethyl o-benzoylbenzoate,
2-ethylaminoacetophenone,
2-benzylaminoacetophenone,
ω,ω-dichloro-5-bromo-2-aminoacetophenone,
3-dimethylaminoacetophenone,
ω-aminoacetophenone,
2-amino-5-dimethylaminoacetophenone,
2-aminobenzophenone,
2-methylaminobenzophenone,
4-diethylaminobenzophenone,
2,4'-diaminobenzophenone,
4,4'-bis(dimethylamino)benzophenone (Michler's ketone),
phenyl-2-pyridyl ketone,
phenyl-2-thienyl ketone,
benzil,
diacetyl,
ω-naphthoylacetonitrile,
acetylacetone,
ω,ω,ω-tribromoacetophenone,
ω,ω,ω-tribromo-3-nitroacetophenone,
phenyl-2-propanone,
cyclohexyl phenyl ketone,
dicyclohexyl ketone,
1,4-benzoquinone,
1,4-naphthoquinone,
1,2-naphthoquinone,
2,5-diethoxy-p-benzoquinone,
1,6-pyrenequinone,
2-methylanthraquinone, and
1-H-benzonaphthen-1-one.

The preferred ketone photosensitizers are dialkyl ketones, diaryl ketones and alkyl aryl ketones, particularly Michler's ketone and benzophenene, Hexaarylbiimidazole sensitizers, sometimes called 2,4,5-triarylimidazolyl dimers, absorb radiation maximally in the 2500 to 3700A region, and usually show some, though lesser, absorption in the 3000–3750A region. The hexaarylbiimidazoles can be represented by the formula

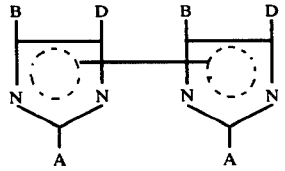

wherein A, B and D represent aryl groups which can be the same or different, carbocyclic or heterocyclic, unsubstituted or substituted with substituents that do not interfere with the dissociation of the hexaarylbiimidazole to the triarylimidazolyl radical upon irradiation. Each dotted circle represents four delocalized electrons (i.e., two conjugated double bonds) which satisfy the valences of the carbon and nitrogen atoms of the imidazole ring. The B and D aryl groups can each be substituted with 0–3 substituents and the A aryl groups can be substituted with 0–4 substituents. The aryl groups include one- and two-ring aryls, such as phenyl, biphenyl, naphthyl, pyridyl, furyl and thienyl. Suitable substituents include halogen, cyano, lower hydrocarbyl (including alkyl, haloalkyl, cyanoalkyl, hydroxyalkyl, and aryl), lower alkoxy, aryloxy, lower alkylthio, arylthio, sulfo, alkylsulfonyl, arylsulfonyl, nitro, and lower alkylcarbonyl. In the foregoing list, the alkyl groups are preferably of 1–6 carbon atoms, while the aryl groups are preferably of 6–10 carbon atoms.

Representative hexaarylbiimidazoles which may be employed in this invention include:

2,2′-bis(o-bromophenyl)-4,4′,5,5′-tetraphenylbiimidazole,
2,2′-bis(p-bromophenyl)-4,4′,5,5′-tetraphenylbiimidazole,
2,2′-bis(p-carboxyphenyl)-4,4′,5,5′-tetraphenylbiimidazole,
2,2′-bis(o-chlorophenyl)-4,4′,5,5′-tetrakis(p-methoxyphenyl)biimidazole,
2,2′-bis(o-chlorophenyl)-4,4′,5,5′-tetraphenylbiimidazole,
2,2′-bis(o-chlorophenyl)-4,4′,5,5′-tetrakis(p-methoxyphenyl)biimidazole,
2,2′-bis(p-cyanophenyl)-4,4′,5,5′-tetrakis(p-methoxyphenyl)biimidazole,
2,2′-bis)2,4-dichlorophenyl)-4,4′,5,5′-tetraphenylbiimidazole,
2,2′-bis(2,4-dimethoxyphenyl)-4,4′,5,5′-tetraphenylbiimidazole,
2,2′-bis(o-ethoxyphenyl)-4,4′,5,5′-tetraphenylbiimidazole,
2,2′-bis(m-fluorophenyl)-4,4′,5,5′-tetraphenylbiimidazole,
2,2′-bis(o-fluorophenyl)-4,4′,5,5′-tetraphenylbiimidazole,
2,2′-bis(p-fluorophenyl)-4,4′,5,5′-tetraphenylbiimidazole,
2,2′-bis(o-hexoxyphenyl)-4,4,40 ,5,5′-tetraphenylbiimidazole,
2,2′-bis(o-hexylphenyl)-4,4′,5,5′-tetrakis(p-methoxyphenyl)biimidazole,
2,2′-bis(3,4-methylenedioxyphenyl)-4,4′,5,5′-tetraphenylbiimidazole,
2,2′-bis(o-chlorophenyl)-4,4′,5,5′-tetrakis(m-methoxyphenyl)biimidazole,
2,2′-bis(o-chlorophenyl)-4,4′,5,5′-tetrakis[m-(beta-phenoxyethoxyphenyl)]biimidazole,
2,2′-bis(2,6-dichlorophenyl)-4,4′,5,5′-tetraphenyl)-biimidazole,
2,2′-bis(o-methoxyphenyl)-4,4′,5,5′-tetraphenylbiimidazole,
2,2′-bis(p-methoxyphenyl)-4,4′-bis(o-methoxyphenyl)-5,5′-diphenylbiimidazole,
2,2′-bis(o-nitrophenyl)-4,4′,5,5′-tetraphenylbiimidazole,
2,2′-bis(p-phenylsulfonylphenyl)-4,4′,5,5′-tetraphenylbiimidazole,
2,2′-bis(p-sulfamoylphenyl)-4,4′,5,5′-tetraphenylbiimidazole,
2,2′-bis(2,4,6-trimethylphenyl)-4,4′,5,5′-tetraphenylbiimidazole,
2,2′-di-4-diphenylyl-4,4′,5,5′-tetraphenylbiimidazole,
2,2′-di-1-naphthyl-4,4′,5,5′-tetrakis(p-methoxyphenyl)biimidazole,
2,2′-di-9-phenanthryl-4,4′,5,5′-tetrakis(p-methoxyphenyl)biimidazole,
2,2′-diphenyl-4,4′,5,5′-tetra-4-diphenylbiimidazole,
2,2′-diphenyl-4,4′,5,5′-tetra-2,4-xylylbiimidazole,
2,2′-di-3-pyridyl-4,4′,5,5′-tetraphenylbiimidazole,
2,2′-di-3-thienyl-4,4′,5,5′-tetraphenylbiimidazole,
2,2′-di-o-tolyl-4,4′,5,5′-tetraphenylbiimidazole,
2,2′-di-p-tolyl-4,4′-di-o-tolyl-5,5′-diphenylbiimidazole,
2,2′-di-2,4-xylyl-4,4′,5,5′-tetraphenylbiimidazole,
2,2′,4,4′,5,5′-hexakis(p-benzylthiophenyl)-biimidazole,
2,2′,4,4′,5,5′-hexa-1-naphthylbiimidazole,
2,2′,4,4′,5,5′-hexaphenylbiimidazole,
2,2′-bis(2-nitro-5-methoxyphenyl)-4,4′,5,5′-tetraphenylbiimidazole,
2,2′-bis(o-nitrophenyl)-4,4′,5,5′-tetrakis(m-methoxyphenyl)biimidazole, and
2,2′-bis(2-chloro-5-sulfophenyl)-4,4′,5,5′-tetraphenylbiimidazole.

The preferred hexaarylbiimidazoles are those in which the aryl radicals are carbocyclic, particularly phenyl, and the substituents are lower alkyl, lower alkoxy, chloro, fluoro, bromo and benzo groups. The most preferred hexaarylbiimidazoles are 2,2′-bis(o-chlorophenyl)-4,4′,5,5′-tetraphenylbiimidazole and 2,2′-bis(o-chlorophenyl)-4,4′,5,5′-(m-methoxyphenyl)biimidazole. The hexaarylbiimidazoles are conveniently obtained by methods described in U.S. Pat. Nos. 3,479,185 and 3,784,557, and in British Pat. Nos. 997,396 and 1,047,569.

In many cases optimum results are obtained using a mixture of photosensitizers. For example, good results are obtained when a mixture of an aryl ketone and a hexaarylbiimidazole is used.

The amount of photosensitizer used may vary over wide limits depending upon the particular photosensitizer and the particular leuco dye employed. For example, the weight ratio of photosensitizer to leuco dye may vary from about 0.01:1 to about 50:1. The preferred range is about 0.05:1 to 10:1.

Aromatic aldehydes which are useful in this invention are those derived from (1) carbocyclic aromatic compounds, (2) heterocyclic compounds that show aromatic properties, and (3) compounds containing both carbocyclic and heterocyclic rings. Aldehydes preferred for use in the present invention include substituted and unsubstituted benzaldehydes, furfuraldehydes, and pyridine carboxaldehydes. Preferred substituents in substituted aldehydes include one or more selected from the group consisting of $C_1$–$C_6$ alkyl, $NO_2$, CN, CHO, COR, $CO_2H$, $OCH_2CO_2H$, $CO_2R$, $CONH_2$, $SO_2R$, $CF_3$, F, Cl, Br, I and OH, wherein R is phenyl or $C_1$–$C_6$ alkyl. The particularly preferred substituents include Cl, F, $CO_2H$, CN, $CO_2CH_3$, $COCH_3$ and $OCH_2CO_2H$.

Suitable aldehydes for use within the scope of this invention include:

acridine-9-carboxaldehyde,
6-chloro-2-methoxy-acridine-9-carboxaldehyde,
1-, 2- and 9-anthraldehyde,
3-methoxy-2-anthraldehyde,
10-bromo-9-anthraldehyde,
2-chloro-9-anthraldehyde,
10-chloro-2-methyl-9-anthraldehyde,
1,10-dichloro-9-anthraldehyde,
1,8-anthracenedicarboxaldehyde,
p-acetylbenzaldehyde,
5-acetyl-2,4-dimethoxybenzaldehyde,
p-benzoylbenzaldehyde,
o-, m- and p-bromobenzaldehyde,
3-bromo-4-butoxy-5-methoxybenzaldehyde,
2-bromo-4-cyanobenzaldehyde,
5-bromo-2-nitrobenzaldehyde,
o-tert.-butoxybenzaldehyde,
2-butoxy-3,5-diiodobenzaldehyde,
p-sec.-butylbenzaldehyde,
4-chloro-3-fluorobenzaldehyde,
o-, m- and p-cyanobenzaldehyde,
2,3-dichlorobenzaldehyde,
2,6-dichloro-3-nitrobenzaldehyde,
2,4-diethoxy-5-hexylbenzaldehyde,
3,5-dimethyl-4-nitrobenzaldehyde,
p-ethanesulfonylbenzaldehyde,
4-nitro-2-toluenesulfonylbenzaldehyde,
pentafluorobenzaldehyde,
o- and p-phenoxybenzaldehyde,
2,4,6-tricyano-3,5-dimethylbenzaldehyde,
2,4,5-trichloro-3,6-dimethoxybenzaldehyde,
p-vinylbenzaldehyde,
o-, m- and p-tolualdehyde,
3,5-xylaldehyde (3,5-dimethylbenzaldehyde),
2,4,6-triethylbenzaldehyde,
2,3,5,6-tetramethylbenzaldehyde,
7-, 10- and 12-benz[a]anthracenecarboxaldehyde,
2-benzimidazolecarboxaldehyde,
4,5-dichlorobenzimidazole-2-carboxaldehyde,
1-methylbenzimidazole-2-carboxaldehyde,
o-, m- and p-chlorobenzaldehyde, pl 2,4-dicloroben-zaldehyde,
3,4-dichlorobenzaldehyde,
5-formylsalicylic acid,
p-formylbenzoic acid,
ethyl p-formylbenzoate,
p-trifluoromethylbenzaldehyde,
m-trifluoromethylbenzaldehyde,
p-iodobenzaldehyde,
1-ethyl-2-phenylbenzimidazole-5-carboxaldehyde,
2-, 3- and 5-benzofurancarboxaldehyde,
3-chlorobenzofuran-2-carboxaldehyde,
5-chloro-3,6-dimethylbenzofuran-2-carboxaldehyde,
5-methyl-3-phenylbenzofuran-2-carboxaldehyde,
3-(2-naphthyl)benzofuran-2-carboxaldehyde,
2-ethyl-7-methoxyenzofuran-3-carboxaldehyde,
2,3-dimethylbenzofuran-4-carboxaldehyde,
5-methoxy-2,3-dimethylbenzofuran-6-carboxaldehyde,
benzo[b]naphtho[1,2-d]furan-3-carboxaldehyde,
benzo[c]phenanthrene-5-carboxaldehyde,
2,1,3-benzothiadiazole-4-carboxaldehyde,
2-benzothiazolecarboxaldehyde,
6-nitrobenzothiazole-2-carboxaldehyde,
2-, 3-, 4-, 5-, 6- and 7-benzo[b]thiophenecarboxaldehyde,
3-bromo-7-methylbenzo[b]thiophene-2-carboxaldehyde,
3-nitrobenzo[b]thiophene-2-carboxaldehyde,
7-methylbenzo[b]thiophene-3-carboxaldehyde,
3-bromobenzo[b]thiophene-7-carboxaldehyde,
benzo[b]thiophene-2,3-dicarboxaldehyde,
2-benzoxazolecarboxaldehyde,
benz[a]pyrene-6-carboxaldehyde,
2- and 4-biphenylcarboxaldehyde,
2′-cyano-3,4,4′,5-tetramethoxybiphenyl-2-carboxaldehyde,
4,5,6-trimethoxybiphenyl-2-carboxaldehyde,
4,6-diethylbiphenyl-2-carboxaldehyde,
2′-nitrobiphenyl-2-carboxaldehyde,
3,4,5-trimethoxy-3′-vinylbiphenyl-2-carboxaldehyde,
3-chlorobiphenyl-4-carboxaldehyde,
2,2′-, 3,3′- and 4,4′-biphenyldicarboxaldehyde,
5,5′-diethyl-4,4′,6,6′-tetramethoxybiphenyl-3,3′-dicarboxaldehyde,
1- and 2-carbazolecarboxaldehyde,
1,4,6-trimethylcarbazole-3-carboxaldehyde,
9-ethylcarbazole-3-carboxaldehyde,
1,4-diemthylcarbazole-3,6-dicarboxaldehyde,
2- and 3-dibenzothiophenecarboxaldehyde,
2,8-dibenzothiophenedicarboxaldehyde,
1- and 2-dibenzofurancarboxaldehyde,
2-methoxydibenzofuran-3-carboxaldehyde,
2,8-dibenzofurandicarboxaldehyde,
2- and 3-furaldehyde,
5-chloro-2-foraldehyde (5-chlorofurfural),
2,5-diphenyl-3-furaldehyde,
8-fluoranthenecarboxaldehyde,
1-, 2- and 4-fluorenecarboxaldehyde,
2,7-fluorenedicarboxaldehyde,
1-p-tolylimidazole-4-carboxaldehyde,
3-methylindene-2-carboxaldehyde,
3-indenecarboxaldehyde,
2- and 3-indolecarboxaldehyde,
5-chloroindole-3-carboxaldehyde,
4-cyanoindole-3-carboxaldehyde,
1,2-dimethylindole-3-carboxaldehyde,
1-methyl-2-phenylindole-3-carboxaldehyde,
isophthalaldehyde,
2-methoxy-5-methylisophthalaldehyde,
5-nitroisophthalaldehyde,
tetramethylisophthalaldehyde,
phthalaldehyde,
4-chlorophthalaldehyde,
4,5-dimethoxyphthalaldehyde,
2,5-dichloroterephthalaldehyde,
2,5-diethoxyterephthalaldehyde,
2,5-dimethylterephthalaldehyde,
nitroterephthalaldehyde,
triethylmethylterephthalaldehyde,
methyl isophthalaldehydate (m-methoxycarbonylbenzaldehyde),
methyl 2,6-dimethoxy-4-methylisophthalaldehydate,
ethyl phthalaldehydate,
butyl terephthalaldehyde,
1-isoquinolinecarboxaldehyde (isoquinalaldehyde),
6,7-dimethoxyisoquinoline-1-carboxaldehyde, 3-, 5- and 7-isoquinolinecarboxaldehyde,
5-cyanoisoquinoline-3-carboxaldehyde,
8-nitroisoquinoline-3-carboxaldehyde,
1-phenylisoquinoline-7-carboxaldehyde,
3- and 5-isoxazolecarboxaldehyde,
5-ethoxyisoxazole-3-carboxaldehyde,
3-methylisoxazole-5-carboxaldehyde,
3-phenylisoxazole-5-carboxaldehyde,
5-naphthacenecarboxaldehyde,
5,11-naphthacenedicarboxaldehyde,
1- and 2-naphthaldehyde,
2,8-dimethoxy-1-naphthaldehyde,
2-ethoxy-1-naphthaldehyde,
2-methyl-6-propyl-1-naphthaldehyde,
2-, 5-, and 8-nitro-1-naphthaldehyde,
1-bromo-2-naphthaldehyde,
8-chloro-4,5-dimethoxy-1-methyl-2-naphthaldehyde,
1,3-, 1,4-, 1,5-, 1,6-, 1,7-, 2,3-, 2,6- and 2,7-naphthalenedicarboxaldehyde,
4-oxazolecarboxaldehyde,
5-chloro-2-pentyloxazole-4-carboxaldehyde,
5-methyl-2-phenyloxazole-4-carboxaldehyde,
1-, 2-, 3-, and 9-phenanthrenecarboxaldehyde,
10-bromophenanthrene-9-carboxaldehyde,
4,5-phenanthrenedicarboxaldehyde,
9,10-dimethylphenanthrene-4,5-dicarboxaldehyde,
1- and 3-pyrenecarboxaldehyde,
6-methylpyrene-4-carboxaldehyde,
2-pyridinecarboxaldehyde,
3-pyridinecarboxaldehyde (nicotinaldehyde),
2-, 4-, 5-, and 6-methylnicotinaldehyde,
2,6-pyridinedicarboxaldehyde,
4-methylpyridine-2,6-dicarboxaldehyde,
2- and 3-pyrrolecarboxaldehyde,
4-iodo-3,5-dimethylpyrrole-2-carboxaldehyde,
4-nitropyrrole-2-carboxaldehyde,
1,3,5-trimethylpyrrole-2-carboxaldehyde,
2,4-dimethylpyrrole-3-carboxaldehyde,
4,5-dimethyl-1,2-diphenylpyrrole-3-carboxaldehyde,
3,5-dimethylpyrrole-2,4-dicarboxaldehyde,
1,3,5-trimethylpyrrole-2,4-dicarboxaldehyde,
2,5-dimethylpyrrole-3,4-dicarboxaldehyde,
2-quinolinecarboxaldehyde (quinalaldehyde),
4-quinolinecarboxaldehyde (cinchoninaldehyde),
6-, 7-, and 8-quinolinecarboxaldehyde,
6-bromoquinoline-2-carboxaldehyde,
4,7-dichloroquinoline-2-carboxaldehyde,
6,7-dimethoxy-4-phenylquinoline-2-carboxaldehyde,
6-ethoxyquinoline-2-carboxaldehyde,
7-methylquinoline-2-carboxaldehyde,
6,7-dimethylquinoline-4-carboxaldehyde,
1,3,4-thiadiazole-2-carboxaldehyde,
5-phenyl-1,3,4-thiadiazole-2-carboxaldehyde,
5-methyl-1,3,4-thiadiazole-2-carboxaldehyde,
1,2,5-thiadiazole-3,4-dicarboxaldehyde,
2- and 4-thiazolecarboxaldehyde,
5-iodo-4-methylthiazole-2-carboxaldehyde,
4-phenylthiazole-2-carboxaldehyde,
4-methylthiazole-5-carboxaldehyde,
2- and 3- thiophenecarboxaldehyde,
3-bromothiophene-2-carboxaldehyde,
5-butoxythiophene-2-carboxaldehyde,
4-t-butylthiophene-2-carboxaldehyde,
3,5-dichlorothiophene-2-carboxaldehyde,
5-ethyl-4-methylthiophene-2-carboxaldehyde,
2,5-di-t-butylthiophene-3-carboxaldehyde,
5-nitrothiophene-3-carboxaldehyde,
p-terphenyl-4-carboxaldehyde, and
o-and p-formylphenoxyacetic acid.

The preferred aldehydes include 2,4-dichlorobenzaldehyde, 5-formylsalicyclic acid o-formylphenoxyacetic acid, and p-formylphenoxyacetic acid. The o- and p-formylphenoxyacetic acids are especially preferred.

The weight ratio of aromatic aldehyde to leuco dye should be at least about 0.5:1. An excess amount of aldehyde may be employed, e.g., up to about 100:1. It is preferred to use a ratio of about 2:1 to 20:1.

Amines which are useful in the compositions of this invention include secondary and tertiary amines in which all carbon atoms to which the amino group is attached are aliphatic. The preferred amines are those which contain at least one group of the formula

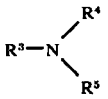

where $R^3$ is H; benzyl; or $C_1$–$C_8$ alkyl, unsubstituted or substituted with hydroxyl, methoxy, ethoxy, or benzyloxy; and $R^4$ and $R^5$, alike or different, are $C_1$–$C_8$ alkyl, unsubstituted or substituted with hydroxyl, methoxy, ethoxy, or benzyloxy; cycloalkyl; benzyl; or together to form a carbocyclic or heterocyclic alicyclic ring, and when more than one amine group is present in the molecule, at least one of $R^3$, $R^4$ or $R^5$ will be a common linking radical. Preferably the amine contains a maximum of 30 carbon atoms.

The amine is believed to function as an electron transfer agent with the photosensitizer, and its presence results in an increase in speed of the imaging system. For example, with a ketone photosensitizer, photoreduction of the ketone occurs by reaction with the amine at a rate much faster than reaction of the ketone triplet state with oxygen.

Amines suitable for use include diisopropylethylamine, N-methylmorpholine, triethylamine, tri-n-propylamine, N,N,N',N'-tetramethylethylenediamine, N,N,N',N'-tetraethylethylenediamine, tribenzylamine, dimethylformamide dimethyl acetal, dimethylformamide diethyl acetal, dimethylformamide dibenzyl acetal, triethanolamine, diethylamine, diisopropylamine, N-methylcyclohexylamine, N-ethyldiethanolamine, tributylamine, diisobutylamine, diheptylamine, diisopentylamine, diisopropanolamine, N-ethylbenzylamine, N-ethylcyclohexylamine, N-methyldioctylamine, 3-dibutylamino-1-propanol, 2-diethylaminoethanol, N,N-dimethylbenzylamine, N,N-dimethylcyclohexylamine, N,N-dimethyloctylamine, tripentylamine and triisopentylamine. Particularly preferred are amines containing a secondary alkyl group adjacent to the nitrogen atom.

The amount of amine present in the composition may vary over wide limits. For example, weight ratios of amine to aldehyde may vary from about 0.1:1 up to about 10:1. Preferably the ratio is about 1:1 to about 3:1.

The above components of the photosensitive composition, i.e., the leuco dye, photosensitizer, aldehyde and amine, should be used in a high state of purity to avoid interference with the photoimaging (color formation) reaction by foreign ingredients.

A polymeric binder may also be employed in the radiation-sensitive composition, if desired. Binders which may optionally be added to the composition are inert materials that serve to adhere the leuco dye/- photosensitizer/aldehyde/amine mixture to a substrate. The binders may also serve to thicken the solution of the composition should this be desirable for specific applications. Binders can also serve as a matrix for the composition and the mixture may be cast, extruded or otherwise formed into unsupported imageable films. Radiation-transparent and film-forming polymers are preferred. Examples of suitable binders include ethyl cellulose, polyvinyl alcohol, polyvinyl chloride, polystyrene, polyvinyl acetate, polymethyl methacrylate, polydialkylaminoethyl methacrylates, cellulose acetate, cellulose acetate butyrate, cellulose nitrate, cellulose butyrate, chlorinated rubber, copolymers of the above vinyl monomers, and gelatin.

The amount of binder present may vary from about 0.1 part to about 200 parts by weight per part of active ingredients, that is, leuco dye, photosensitizer, aldehyde and amine. In general, from about 0.1 to 10 parts are used when the desired effect is as an adhesive or thickener, while higher amounts are used when it is desired to form unsupported films.

With certain polymers, it may be desirable to add a plasticizer to give flexibility to the film or coating. Suitable plasticizers include the polyethylene glycols such as the commercially available carbowaxes, and related materials such as substituted phenol/ethylene oxide adducts, e.g., the polyethers obtained from o-, m-, and p-cresol, o-, m-, and p-phenylphenol and p-nonylphenol, including commercially available materials such as the alkyl phenoxypolyoxyethylene ethanols. Other plasticizers include the acetates, propionates, butyrates and other carboxylate esters of ethylene glycol, diethylene glycol, glycerol, pentaerythritol, and other polyhydric alcohols, and alkyl and aryl phosphates such as tributyl phosphate, trihexyl phosphate, trioctyl phosphate, triphenyl phosphate, tricresyl phosphate and cresyl diphenyl phosphate.

It is sometimes desirable to include a metal sequesterant in the composition to improve the dark-stability of the coated compositions. Transition metal ions, even in trace amounts, are known to catalyze aldehyde autooxidation which leads to dye formation even before exposure to radiation. The sodium salt of ethylenediaminetetraacetic acid is particularly beneficial as a metal sequesterant.

In order to immobilize the dye image once formed and prevent loss of resolution, it is useful to add a material which forms an insoluble salt with the cationic dye. Suitable materials include phosphotungstic acid and polyhedral boranes such as $H_2B_{12}H_{12}$.

The imaging process of this invention employs suitable sheet material having a radiation sensitive coating on one surface thereof. This sheet material is formed by coating or impregnating a suitable substrate with the radiation sensitive composition following known techniques. Suitable substrates include materials commonly used in the graphic arts and in decorative applications such as paper ranging from tissue paper to heavy cardboard; films of plastics and polymeric materials such as regenerated cellulose, cellulose acetate, cellulose nitrate, polyesters from glycols and terephthalic acid, vinyl polymers and copolymers, polyethylene, polyvinyl acetate, polymethyl methacrylate, polyvinyl chloride; textile fabrics; glass; wood; and metals.

The photoimaging composition, usually as a solution in a carrier solvent, may be sprayed, brushed, applied by a roller or an immersion coater, flowed over the surface, picked up by immersion or applied to the substrate by other means. The solvent is then allowed to evaporate. In general, solvents are employed which are volatile at ordinary pressures. Examples of suitable solvents include amines such as N,N-dimethylformamide and N,N-dimethylacetamide; alcohols and ether alcohols such as methanol, ethanol, 1-propanol, 2-propanol, butanol and ethylene glycol; esters such as methyl acetate and ethyl acetate; aromatic hydrocarbons and aromatic halocarbons such as benzene, o-dichlorobenzene and toluene; ketones such as acetone, methyl ethyl ketone, and 3-pentanone; aliphatic halocarbons such as methylene chloride, chloroform, 1,1,2-trichloroethane, 1,1,2,2-tetrachloroethane, 1,1,2-trichloroethylene; miscellaneous solvents such as dimethyl sulfoxide, pyridine, tetrahydrofuran. 1,2-dimethoxyethane, dioxane, dicyanocyclobutane, N-methylpyrrolidone; and mixtures of these solvents in various proportions as may be required to attain solutions.

It is often beneficial to leave a small residue of solvent in the dried composition so that the desired degree of imaging can be obtained upon subsequent irradiation. Ordinary drying such as that employed in paper manufacture or in film casting results in the retention of ample solvent to give a composition with good photosensitivity. The compositions so produced are dry to the touch and stable to storage at room temperature.

Colored images are produced in accordance with this invention by exposing the leuco dye composition to radiation a portion of which contains wavelengths between about 2000 and 5000A through an image-bearing transparency. Any convenient source of ultraviolet radiation may be used for color formation. Suitable sources include ordinary sunlight and artificial sources such as sunlamps, pulsed and continuous xenon flash lamps, germicidal lamps, ultraviolet lamps providing specifically radiation of short wavelength (2537A), and lamps providing radiation of longer wavelengths, narrow or broad band, centered near 3600A, 4200A, 4500A, or 5000A, such as fluorescent lamps, mercury, metal additive, and arc lamps. Argon glow lamps, photographic flood lamps, and other fluorescent light sources such as the tracings on the face of a cathode ray tube may also be used. Electron accelerators and electron beam sources through an appropriate mask are also suitable. The radiation exposure time may vary from fractions of a second to minutes, depending upon the intensity and spectral energy distribution of the radiation, its distance from the composition, the nature and amount of the composition available, and the intensity of color in the image desired. Customarily, a mercury vapor arc or a sunlamp is used at a distance of about 1.5 to 20 inches (3.8–50.8 cm) from the photosensitive composition.

After the imaging exposure the composition may be rendered insensitive to further irradiation by immersion in a liquid containing a free radical reaction inhibitor. Aqueous solutions or suspensions of such inhibitors as hydroquinone, 2,6-di-t-butylphenol, 2,6-di-t-butyl-4-methylphenol and the like are satisfactory.

Applications for using leuco dye compositions in imaging processes are well known to those skilled in the art. The images to be recorded may be captured as direct or latent images using various devices for optical printing. With the described compositions, entire sheets may be printed as a complete format, or as composite information consisting of lines, characters, or bits printed in sequence. These images are readily visible and can be read out by suitable optical devices.

Photographic masks may be used for printing fixed format data such as lines, maps, plots, graphic and alphanumeric information. Variable information may be printed by creating individual characters serially or by printing information by a series of individual lines or dots. This may be accomplished by using a mask operated by electrostatic and/or magnetic devices. Transfer of such information from the masks can be accomplished using contact or projection printing techniques. Specific applications for these imaging techniques include photocopying of typescript and pencil drawings, preparation of overhead transparencies, and reproduction of engineering drawing film images. In each case the compositions of this invention containing a photosensitizer, an aldehyde and an amine provides a faster image, that is, the desired image intensity after a shorter exposure time, or a higher image intensity at the same exposure time, than comparable compositions containing only a photosensitizer or an aldehyde.

EXAMPLES OF THE INVENTION

The following examples illustrate the novel compositions of this invention and their use. All parts and percentages are by weight unless otherwise specified.

EXAMPLE 1

Self-supporting films were prepared as follows: 100 parts of a binder solution consisting of cellulose acetate butyrate (17% butyryl) solution in acetone (10%) was mixed with 20 parts of diisopropylethylamine, 15 parts of tricresyl phosphate, 8 parts of the aldehyde specified in Table I, 2 parts of 4,4'-bis(dimethylamino)benzophenone, 1,5 parts of Leucocrystal Violet, and 1 part of benzophenone. The solution was cast into a glass plate with a 10-mil (0.0254 cm) doctor knife to give films, after drying, of 1.1–1.5 mils (0.0028–0.0038 cm) in thickness. The films were exposed at a distance of 8 inches (20.3 cm) to a GE H85A3 medium pressure mercury resonance lamp attenuated through a wire screen. Under this configuration, there is a total radiation incident on a plate 8 inches (20.3 cm) from the lamp of 0.4 $\mu j/cm^2/sec$. Optical densities of the dye formed during the exposure were read on a Macbeth Quantalog RD-100 densitometer.

Table I gives the optical density obtained for the given incident light energy for a variety of aldehydes.

TABLE I

| No. | Aldehyde | Exposure Time (sec.) | Light Energy ($\mu j/cm^2$) | Optical Density |
|---|---|---|---|---|
| 1 | 2-Bromobenzaldehyde | 450 | 180 | 1.04 |
| | | 900 | 360 | 1.28 |
| 2 | o-Formylbenzoic Acid[1] | 450 | 180 | 0.82 |
| | | 750 | 300 | 1.00 |
| 3 | 4-Allyloxybenzaldehyde | 450 | 180 | 0.64 |
| | | 900 | 360 | 0.83 |
| 4 | 3,5-Dichloro-2-hydroxy-benzaldehyde | 900 | 360 | 0.67 |
| 5 | 2-Furfural | 900 | 360 | 0.81 |
| 6 | 3-Cyanobenzaldehyde | 900 | 360 | 0.95 |
| 7 | 5-Acetoxymethyl-2-furfur-aldehyde | 900 | 360 | 1.04 |
| 8 | 3,4-Dichlorobenzaldehyde | 900 | 360 | 1.11 |
| 9 | 2-Carbomethoxybenzaldehyde | 900 | 360 | 0.93 |
| 10 | 4-Acetoxybenzaldehyde[2] | 900 | 360 | 1.15 |
| 11 | 2-Chloro-6-fluorobenz-aldehyde | 900 | 360 | 1.03 |
| 12 | 3-Fluorobenzaldehyde | 900 | 360 | 0.98 |
| 13 | 5-Formylsalicylic Acid | 900 | 360 | 1.33 |
| 14 | 2,4-Dichlorobenzaldehyde[3] | 315 | 125 | 1.06 |
| | | 1000 | 400 | 1.40 |
| 15 | 2,6-Dichlorobenzaldehyde[3] | 700 | 280 | 0.91 |
| | | 1000 | 400 | 0.93 |

[1]Film thickness was 2.0 mils (0.0051 cm)
[2]Film thickness was 2.1 mils (0.00534 cm)
[3]Film thickness was 4 mils (0.0102 cm)

EXAMPLE 2

This example compares the effectiveness of various amines in the photoimaging process. Approximately 4-mil (0.0102 cm) films were prepared from 100 parts of the binder solution of Example 1, 15 parts of tricresyl phosphate, 10 parts of 2,4-dichlorobenzaldehyde, 2 parts of 4,4'-bis(dimethylamino)benzophenone, 2 parts of Leucocrystal Violet, 1 part of benzophenone, 1 part of the sodium salt of ethylenediaminetetraacetic acid and 20 parts of an amine. The films were dried and exposed to radiation as described in Example 1. The results are summarized in Table II.

TABLE II

| No. | Amine | Exposure Time (sec.) | Light Energy ($\mu j/cm^2$) | Optical Density |
|---|---|---|---|---|
| 1 | N-Methylmorpholine | 1000 | 400 | 0.70 |
| 2 | Tri-n-propylamine | 1000 | 400 | 0.72 |
| 3 | Tetramethylethylene-diamine | 1000 | 400 | 0.73 |
| 4 | Tribenzylamine | 1000 | 400 | 0.98 |
| 5 | Dimethylformamide di-methyl acetal | 315 | 126 | 0.60 |
| 6 | Diisopropylethylamine | 315 | 126 | 0.80 |
| | | 500 | 200 | 1.12 |

EXAMPLE 3

A coating dope was prepared from 100 parts of a 10% cellulose acetate butyrate solution in acetone, 20 parts of diisopropylethylamine, 15 parts of tricresyl phosphate, 8 parts of 2,4-dichlorobenzaldehyde, 2 parts of Leucocrystal Violet, 2 parts of Michler's ketone, and 1 part of benzophenone. This dope was coated onto a polyester base film to give a coating thickness of 0.15 ml (0.00038 cm). The coated film was exposed to a 275 watt sunlamp for 3 seconds at a distance of 12 inches (30.4 cm) to give an optical density of 0.92.

EXAMPLE 4

This example demonstrates the use of a second binder in the coating composition.

A coating dope was prepared from 100 parts of a 10% cellulose acetate butyrate solution in acetone, 20 parts of diisopropylethylamine, 15 parts of tricresyl phosphate, 10 parts of 2,4-dichlorobenzaldehyde, 10 parts of a methacrylic acid polymer, 2 parts of Leucocrystal Violet, 2 parts of Michler's ketone, 1 part of the sodium salt of ethylenediaminetetraacetic acid, and 1 part of benzophenone. A self-supporting film was cast onto glass from the dope. Exposure of the film for 1000 seconds to the radiation of Example 1 (400 $\mu j/cm^2$) gave an optical density of 0.98.

In another experiment, the methacrylic acid polymer was replaced by a polymer of acrylic acid and the resultant coating dope exposed as before. An optical density of 1.23 was obtained with this film.

EXAMPLE 5

A coating dope was prepared from 100 parts of a 10% solution of cellulose acetate butyrate in acetone, 20 parts of diisopropylethylamine, 15 parts of tricresyl phosphate, 8 parts of 2,6-dichlorobenzaldehyde, 2 parts of camphorquinone, 1 part of benzophenone, and 1 part of Leucocrystal Violet. The solution was cast onto a glass plate and exposed to the radiation described in Example 1. The radiation was attenuated through an additional filter (Corning 4050) to give a total radiation incident on a plate 8 inches (20.3 cm) from the lamp of 0.04 $\mu j/cm^2$/second. A dye image was seen after a 0.1 second exposure.

A similar dope in which the camphorquinone was replaced with 2 parts of Michler's ketone gave similar results upon exposure to radiation.

EXAMPLE 6

A coating dope was prepared from 100 parts of a 10% solution of cellulose acetate butyrate in acetone, 20 parts of diisopropylethylamine, 15 parts of tricresyl phosphate, 3 parts of benzophenone, 8 parts of 2,6-dichlorobenzaldehyde, and 2 parts of Leucomethylene Blue. The solution was cast onto a glass plate, and the dried coating was exposed as described in Example 5. A dye image was observed after a 0.5 second exposure (0.02 $\mu j/cm^2$ of radiation energy).

EXAMPLE 7

A film was cast from a dope consisting of 100 parts of a 10% solution of cellulose acetate butyrate in acetone, 20 parts of diisopropylethylamine, 15 parts of tricresyl phosphate, 8 parts of 2,6-dichlorobenzaldehyde, 5 parts of Leucomalachite Green, 2 parts of benzophenone, and 2 parts of Michler's ketone. A green dye image was obtained after exposure of the cast film to ultraviolet radiation as described in Example 1.

EXAMPLE 8

A film was cast from a dope consisting of 100 parts of a 10% solution of cellulose acetate butyrate in acetone, 15 parts of tricresyl phosphate, 10 parts of triethanolamine triacetate, 8 parts of 2,4-dichlorobenzaldehyde, 2 parts of Michler's ketone, 1.5 parts of Leucocrystal Violet and 1 part of benzophenone. The solution was cast onto a glass plate, and the dried coating was exposed as described in Example 5. A dye image was observed after 0.5 second exposure (0.02 $\mu j/cm^2$ of radiation energy).

EXAMPLE 9

A film was cast from a dope consisting of 50 parts of a 33% solution of polybutyl methacrylate in 2-butanone, 10 parts of diisopropylethylamine, 8 parts of 2,4-dichlorobenzaldehyde, 2 parts of Leucocrystal Violet, 2 parts of Michler's ketone and 1 part of benzophenone. The solution was cast onto a glass plate, and the dried coating was exposed as described in Example 5. A dye image was obtained after a short exposure.

EXAMPLE 10

A coating dope in a solution suitable for spraying was prepared as follows: To 850 parts of solution A, prepared by mixing 166 parts of acetone, 140 parts of toluene, 80 parts of 2-methoxyethyl acetate, 8 parts of 95% ethanol and 10 parts of cellulose acetate butyrate, was added 40 parts of diisopropylethylamine, 40 parts of tricresyl phosphate, 20 parts of 2,4-dichlorobenzaldehyde, 4 parts of Leucocrystal Violet, 4 parts of Michler's ketone and 2 parts of benzophenone. The solution was sprayed onto a polyester base film to give an approximately 3-mil (0.0076 cm) coating after drying. A dye image was formed rapidly upon exposure of the coating to radiation from a sunlamp.

EXAMPLE 11

A coating dope was prepared from 100 parts of a 10% solution of cellulose acetate butyrate in acetone, 15 parts of tricresyl phosphate, 10 parts of 2,4-dichlorobenzaldehyde, 4 parts of 2,2'-bis(o-chlorophenyl)-4,4',5,5'-tetra(m-methoxyphenyl)biimidazole, 3 parts of benzophenone, 3 parts of Leucocrystal Violet and 1 part of the sodium salt of ethylenediaminetetraacetic acid. A self-supporting film was cast onto a glass plate and the dried coating was exposed for 50 seconds to the radiation of Example 1 (20 $\mu j/cm^2$). The exposed coating had an optical density of 1.18.

EXAMPLE 12

A coating dope was prepared from 100 parts of a 10% solution of cellulose acetate butyrate in acetone, 20 parts of diisopropylethylamine, 15 parts of tricresyl phosphate, 10 parts of 2,4-dichlorobenzaldehyde, 2 parts of Leucocrystal Violet, 2 parts of Michler's ketone, 2 parts of 2,2'-bis(o-chlorophenyl)-4,4',5,5'-tetraphenylbiimdazole, 1 part of benzophenone and 1 part of sodium salt of ethylenediaminetetraacetic acid. A self-supporting film was cast onto a glass plate and the dried coating was exposed for 100 seconds to the radiation of Example 1 (40 $\mu j/cm^2$). The exposed coating had an optical density of 0.86.

EXAMPLE 13

A self-supporting film was prepared as follows: Fifty parts of a 10% solution of cellulose acetate butyrate (17% butyryl) in acetone was mixed with 4parts of 2,4-dichlorobenzaldehyde, 10 parts of diisopropylethylamine, 7.5 parts of tricresyl phosphate, 1 part of Leucomalachite Green-4''-chlorocarbonate hydrochloride, 1 part of Michler's ketone and 0.5 part of benzophenone. The mixture was cast onto a glass plate with a 10-mil (0.0254 cm) doctor knife, and the film was dried for 90 minutes. The film was exposed on a vacuum frame to a 275 watt sunlamp for 10 minutes through a process transparency. The exposed film was washed with an aqueous hydroquinone solution, and image quality was examimed visually with a 10X magnifying glass. The image was examined again after 14 days and was found to have retained its original quality.

EXAMPLE 14

A film, prepared as described in Example 13, was exposed to a GE S-4 mercury resonance lamp in a polyethylene vacuum bag for 10 minutes through a process transparency. The exposed film was washed with an aqueous hydroquinone solution, and image quality was examined visually with a 10X magnifying glass. The image was examined again after 35 days and was found to have retained its original quality.

EXAMPLE 15

A self-supporting film was prepared as follows: 50 parts of a 10% solution of cellulose acetate butyrate (17% butyryl) in acetone was mixed with 4 parts of 2,4-dichlorobenzaldehyde, 10 parts of diisopropylethylamine, 7.5 parts of tricresyl phosphate, 1 part of Leucocrystal Violet lactone, 1 part of Michler's ketone and 0.5 part of benzophenone. The mixture was cast onto a glass plate with a 10-mil (0.0254 cm) doctor knife, and the film was dried for 90 minutes. The film was exposed as described in Example 1, and the optical density measured as a function of exposure time. After 450 seconds, the optical density was 0.30.

EXAMPLE 16

A film, prepared as described in Example 15, was exposed for 20 minutes to a GE S-4 mercury resonance lamp through a process transparency. The exposed film was washed with an aqueous hydroquinone solution, and image quality was examined visually with a 10X magnifying glass. The image was examined again after 7 days and was found to have retained its original quality.

EXAMPLE 17

A. A coating dope was prepared from 100 parts of a 10% solution of cellulose acetate butyrate in acetone, 20 parts of diisopropylethylamine, 20 parts of tricresyl phosphate, 10 parts of p-formylphenoxyacetic acid, 4 parts, of 2,2'-bis(o-chlorophenyl)-4,4',5,5'-tetraphenylbiimidazole, 3 parts of Leucocrystal Violet, 2 parts of benzophenone, and 1 part of the sodium salt of ehtylenediaminetetraacetic acid. A self supporting film was cast onto oriented polyester film to give a coating layer 0.01 cm thick. Exposure of the film for 500 seconds to the radiation of Example 1 (200 $\mu$l/cm$^2$) gave an optical density of 1.56.

B. A similar film was prepared with a dope identical to the above except that the p-formylphenoxyacetic acid was replaced with 10 parts of 2,4-dichlorobenzaldehyde. The exposed film had an optical density of 1.44.

EXAMPLE 18

A coating dope was prepared from 50 parts of a 10% solution of cellulose acetate butyrate in tetrahydrofuran, 45 parts of tetrahydrofuran, 20 parts of diisopropylethylamine, 5 parts of tricresyl phosphate, 5 parts of o-formylphenoxyacetic acid, 5 parts of p-formylphenoxyacetic acid, 3 parts of benzophenone, 3 parts of 2,2'-bis(o-chlorophenyl)-4,4',5,5'-tetraphenylbiimidazole, and 3 parts of 3-chloro-4-dimethylaminophenyl-bis(4-dimethylaminophenyl)methane. A self-supporting film was cast onto oriented polyester film to give a coating layer 0.01 cm thick. Exposure of the film for 500 seconds to the radiation of Example 1 (200 $\mu$j/cm$^2$) gave an optical density of 1.33.

The embodiments of the invention in which an exclusive property or privilege is claimed are defined as follows:

1. A radiation sensitive leuco dye composition which comprises 1. a photosensitive leuco dye which is exidizable to a colored form by exposure to radiation,
2. 0.01 to 50 parts by weight, per part of leuco dye, of photosensitizer for the dye selected from the group consisting of ketones, hexaarylbiimidazoles, and perylene,
3. 0.5 to 100 parts by weight, per part of leuco dye, of an aromatic aldehyde,
4. 0.1 to 10 parts by weight, per part of aromatic aldehyde, of a secondary or tertiary amine is of the formula

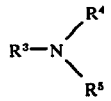

in which $R^3$ is H; benzyl; or $C_1$–$C_8$ alkyl, unsubstituted or substituted, and $R^4$ and $R^5$, alike or different, are $C_1$–$C_8$ alkyl, unsubstituted or substituted; cyclohexyl; benzyl; or together form a carbocyclic or hetero-O-cyclic portion of an alicyclic 6-membered ring.

2. The radiation sensitive leuco dye composition of claim 1 in which the photosensitizer is selected from the group consisting of dialkyl ketones, diaryl ketones, alkyl aryl ketones, hexaarylbiimidazoles and perylene.

3. The radiation sensitive leuco dye composition of claim 2 in which the amine contains one or two group of the formula

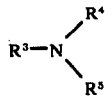

in which $R^3$ is H; benzyl; or $C_1$–$C_8$ alkyl, unsubstituted or substituted with hydroxyl, methoxy, ethoxy, or benzyloxy, and $R^4$ and $R^5$, alike or different, are $C_1$–$C_8$ alkyl, unsubstituted or substituted with hydroxyl, methoxy, ethoxy, or benzyloxy, cyclohexyl; benzyl; or together form a carbocyclic or hetero-O-cyclic portion of an alicyclic 6-membered ring, and when two amine groups are present in the molecule, one of $R^3$, $R^4$ or $R^5$ is a common linking radical.

4. The radiation sensitive leuco dye composition of claim 3 in which the photosensitizer is selected from the group consistig of diaryl ketones and hexaarylbiimidazoles.

5. The radiation sensitive leuco dye composition of claim 4 which also contains 0.1 to 200 parts by weight, per part of active ingredients, of a binder.

6. The radiation sensitive leuco dye composition of claim 4 in which the leuco dye is an aminotriarylmethane or an aminophenothiazine.

7. The radiation sensitive leuco dye composition of claim 6 in which the aromatic aldehyde is selected from the group consisting of benzaldehydes, furfuraldehydes and pyridinecarboxaldehydes.

8. The radiation sensitive leuco dye composition of claim 7 in which the leuco dye is Leucomethylene Blue.

9. The radiation sensitive leuco dye composition of claim 7 in which the leuco dye is an aminotriarylmethane of the formula

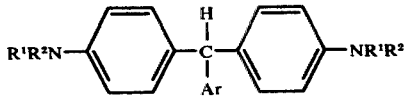

in which $R^1$ and $R^2$, alike or different, are selected from the group consisting of hydrogen, $C_1$ to $C_{10}$ alkyl, 2-hydroxyethyl, 2-cyanoethyl, benzyl and phenyl; and Ar is selected from the group consisting of

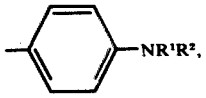

thienyl, furyl, oxazolyl, pyridyl, thiazolyl, indolyl, indolinyl, benzoxazolyl, quinolyl, benzothiazolyl, phenyl, and naphthyl.

10. The radiation sensitive leuco dye composition of claim 9 in which the photosensitizer is present in the amount of 0.05 to 10 parts per part of leuco dye.

11. The radiation sensitive leuco dye composition of claim 10 in which the aromatic aldehyde is present in the amount of 2 to 20 parts per part of leuco dye.

12. The radiation sensitive leuco dye composition of claim 11 in which the amine is present in the amount of 1 to 3 parts by weight per part of aromatic aldehyde.

13. The radiation sensitive leuco dye composition of claim 12 which also contains 0.1 to 200 parts by weight, per part of active ingredients, of a binder.

14. The radiation sensitive leuco dye composition of claim 13 in which the binder is present in the amount of 0.1 to 10 parts per part of active ingredients.

15. The radiation sensitive leuco dye composition of claim 12 in which the leuco dye is Leucocrystal Violet, Leucomalachite Green, Leucomalachite Green-4''-chlorocarbonate hydrochloride, and Leucocrystal Violet lactone.

16. The radiation sensitive leuco dye composition of claim 15 in which the photosensitizer is a mixture containing at least one diaryl ketone.

17. The radiation sensitive leuco dye composition of claim 16 in which the aromatic aldehyde is selected from the group consisting of 2,4-dichlorobenzaldehyde, 5-formylsalicyclic acid, o-formylphenoxyacetic acid and p-formylphenoxyacetic acid.

18. The radiation sensitive leuco dye composition of claim 17 in which the photosensitizer is a mixture of benzophenone and 4,4'-bis(dimethylamino)benzophenone.

19. The radiation sensitive leuco dye composition of claim 17 in which the photosensitizer is a mixture of benzophenone and 2,2'-bis(o-chlorophenyl)-4,4',5,5'-tetraphenylbiimidazole.

20. Radiation sensitive sheet material which comprises a substrate having on one surface thereof a radiation sensitive coating of the composition of claim 1.

21. Method of producing colored images on a substrate which comprises a. coating the substrate with a radiation sensitive leuco dye composition of claim 1, and b. exposing the leuco dye composition to radiation, a portion of which contains wavelengths between 2000 and 5000A, through an image-bearing transparency to obtain a colored image.

* * * * *